US012618126B2

(12) United States Patent
Thoma et al.

(10) Patent No.: US 12,618,126 B2
(45) Date of Patent: May 5, 2026

(54) CHROMIUM-MOLYBDENUM-ALUMINUM ALLOYS WITH OXIDATION-RESISTANCE IMPARTED BY THERMAL PRE-TREATMENT

(71) Applicant: Wisconsin Alumni Research Foundation, Madison, WI (US)

(72) Inventors: Dan Thoma, Fitchburg, WI (US); Michael Niezgoda, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 405 days.

(21) Appl. No.: 18/342,081

(22) Filed: Jun. 27, 2023

(65) Prior Publication Data

US 2025/0003036 A1 Jan. 2, 2025

(51) Int. Cl.

| | |
|---|---|
| ***C22C 27/06*** | (2006.01) |
| ***C22C 1/02*** | (2006.01) |
| ***C22C 27/04*** | (2006.01) |
| ***C22C 30/00*** | (2006.01) |
| ***C22C 32/00*** | (2006.01) |
| ***C22F 1/11*** | (2006.01) |
| ***C22F 1/18*** | (2006.01) |

(52) U.S. Cl.

CPC ..... *C22C 32/0005* (2013.01); *C22C 1/02* (2013.01); *C22C 27/04* (2013.01); *C22C 27/06* (2013.01); *C22C 30/00* (2013.01); *C22F 1/11* (2013.01); *C22F 1/18* (2013.01)

(58) Field of Classification Search

CPC ..... C22C 1/045; C22C 27/06; C22F 1/11

See application file for complete search history.

(56) References Cited

U.S. PATENT DOCUMENTS

| | | | | |
|---|---|---|---|---|
| 2,883,283 | A | 4/1959 | Wainer | |
| 4,762,557 | A | 8/1988 | Nagarajan et al. | |
| 2007/0003428 | A1* | 1/2007 | Gu | C22C 27/06 420/428 |
| 2020/0080184 | A1 | 3/2020 | Walter et al. | |

FOREIGN PATENT DOCUMENTS

| | | |
|---|---|---|
| EP | 2980263 A1 | 2/2016 |
| WO | WO 93/07302 | 4/1993 |

OTHER PUBLICATIONS

Daneshmand, S., C. Aghanajafi, and A. Ahmadi Nadooshan. "The effect of chromium coating in RP technology for airfoil manufacturing." Sadhana 35.5 (2010): 569-584.*

Akiyama, et al., "The Corrosion Behavior of Sputter-Deposited Amorphous Al—Cr—Mo Alloys in 1 M HCl," Corrosion Science, 1996, pp. 279-292, vol. 38, No. 2.

* cited by examiner

*Primary Examiner* — Jessee R Roe

(74) *Attorney, Agent, or Firm* — Bell & Manning, LLC

(57) ABSTRACT

Ternary chromium-molybdenum-aluminum (CrMoAl) alloys that form oxidation-resistant surface films for high-temperature applications are provided. Also provided are methods for thermally pre-treating the alloys to form the oxidation resistant surface films. The surface films have a stratified structure that includes an exterior surface oxide layer comprising chromium oxides and aluminum oxides and an interior aluminum nitride-rich region comprising aluminum nitride precipitates dispersed in a CrMoAl alloy matrix. The interior aluminum nitride precipitates act as oxygen sinks to sequester oxygen diffusing inward into the CrMoAl to prevent further oxidation of the underlying bulk alloy.

20 Claims, 7 Drawing Sheets

Top: 1000 °C Bottom: 1300 °C

Top: 1100 °C Bottom: 1400 °C

Top: 1200 °C Bottom: 1500 °C

| Phases Present | Cr (at%) | Mo | Al | N | O |
|---|---|---|---|---|---|
| Oxide | 29.20 | 0.03 | 5.34 | 0.00 | 65.42 |
| Bulk forward of Oxygen | 81.0 | 17.1 | 0.4 | 0.0 | 1.5 |
| Dark Precip | 0.5 | 0.1 | 44.6 | 15.5 | 39.3 |
| Light Precip | 3.9 | 0.9 | 45.1 | 0.0 | 50.1 |
| Dark Phase Behind Oxide | 27.9 | 8.1 | 14.5 | 1.3 | 48.1 |
| Matrix Behind Oxide Front | 76.9 | 17.4 | 1.7 | 0.0 | 4.0 |

CHROMIUM-MOLYBDENUM-ALUMINUM ALLOYS WITH OXIDATION-RESISTANCE IMPARTED BY THERMAL PRE-TREATMENT

BACKGROUND

At extreme speeds, sharp aerodynamic bodies such as leading edges, nose cones, and control surfaces are subject to aerodynamic heating. These intense thermal environments can cause degradation of flight surfaces or malfunction of components, resulting in extended maintenance schedules, high costs, and low mission readiness. Therefore, it has been proposed to place thermally resistant metals, metal alloys, such as nickel-based alloys, and ceramic matrix composites (CMCs) in areas of high thermal impingement. Refractory metal alloys have seen a resurgence in interest for these types of high temperature aerospace applications in recent years. Molybdenum alloys have much higher melting points compared to nickel-based alloys, and improved strength at high temperature, better manufacturability and inherent toughness over ceramics and CMCs. However, the use of molybdenum alloys has been limited by their tendency to degrade in oxidizing environments.

SUMMARY

Articles of manufacture formed from ternary chromium-molybdenum-aluminum alloys that form oxidation-resistant surface films for high-temperature applications upon thermal pre-treatment are provided. Also provided are methods for thermally pre-treating the alloys to form the oxidation resistant surface films.

Some embodiments of the ternary chromium-molybdenum-aluminum alloys from which articles for use in extreme high-temperature environments can be made have the composition $Cr_{(1-x-y)}Mo_xAl_y$, where $0.10 \leq x \leq 0.20$ and $0.10 \leq y \leq 0.20$.

One embodiment of a thermally pre-treated oxidation-resistant chromium-molybdenum-aluminum alloy includes: a base layer of the ternary chromium-molybdenum-aluminum alloy; a nitride-rich layer over the base layer, the nitride-rich layer comprising aluminum nitride precipitates dispersed in a chromium-molybdenum-aluminum alloy matrix; an oxide-rich layer over the nitride-rich layer, the oxide-rich layer comprising aluminum oxide precipitates dispersed in a chromium-molybdenum-aluminum alloy matrix; and a chromia-rich surface oxide layer over the oxide-rich layer, the chromia-rich surface oxide layer comprising chromium oxides and aluminum oxides.

One embodiment of a method of forming an oxidation-resistant chromium-molybdenum-aluminum alloy of a type described herein includes the steps of: forming a single-phase ternary chromium-molybdenum-aluminum alloy having the composition $Cr_{(1-x-y)}Mo_xAl_y$, where $0.10 \leq x \leq 0.20$ and $0.10 \leq y \leq 0.20$; and exposing the single-phase ternary chromium-molybdenum-aluminum alloy to a heated atmosphere comprising nitrogen gas and oxygen gas at a temperature, T, and for a time sufficient to form a stratified structure comprising: a base layer of a ternary chromium-molybdenum-aluminum alloy; a nitride-rich layer over the base layer, the nitride-rich layer comprising aluminum nitride precipitates dispersed in a chromium-molybdenum-aluminum alloy matrix; an oxide-rich layer over the nitride-rich layer, the oxide-rich layer comprising aluminum oxide precipitates dispersed in a chromium-molybdenum-aluminum alloy matrix; and a chromia-rich surface oxide layer over the oxide-rich layer, the chromia-rich surface oxide layer comprising chromium oxides and aluminum oxides.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

FIG. 1E is an Energy Dispersive X-ray Spectroscopy (EDS) image showing the microstructure of an oxidation resistant film formed on a CrMoAl alloy.

(FIG. 2A); 1100° C. (FIG. 2B); 1200° C. (FIG. 2C); 1300° C. (FIG. 2D); 1400° C. (FIG. 2E); and 1500° C. (FIG. 2F).

DETAILED DESCRIPTION

Ternary chromium-molybdenum-aluminum (CrMoAl) alloys that form oxidation-resistant surface films for high-temperature applications are provided. Also provided are methods for thermally pre-treating the alloys to form the oxidation resistant surface films.

The CrMoAl alloys are useful for the fabrication of articles of manufacture that are exposed to high-temperature oxidizing environments during use. As used herein, the phrase "article of manufacture" refers to an object made from the CrMoAl alloys by tools and/or machinery. Illustrative examples of articles of manufacture include simple bulk objects, such as cast ingots, and more complex objects, such as a component of an aircraft, including a supersonic aircraft, a missile, a rocket, and/or a space vehicle, as well as coatings formed on such components or other substrates. Specific, non-limiting examples of articles of manufacture include nosecones, engine parts, including turbine blades, hot gas reflectors, gas rudders, and coatings on the surfaces thereof.

The ternary CrMoAl alloys that form the protective surface films upon thermal pre-treatment are single-phase alloys characterized by a high chromium content and a high chromium to aluminum atomic ratio. Specific embodiments of the single-phase ternary CrMoAl alloys include those having the composition $Cr_{(1-x-y)}Mo_xAl_y$, where $0.10 \leq x \leq 0.20$ and $0.10 \leq y \leq 0.20$. Some embodiments of the ternary CrMoAl alloys have the composition $Cr_{(1-x-y)}Mo_xAl_y$, where $0.14 \leq x \leq 0.18$ and $0.14 \leq y \leq 0.18$.

the single-phase CrMoAl alloys are exposed to elevated temperatures for a period of time in the presence of gaseous nitrogen ($N_2$) and gaseous oxygen ($O_2$), a stratified structure forms in the alloy surface. Oxidation resistance is imparted to the underlying alloy by the stratified structure, which includes an exterior surface oxide layer comprising chromium oxides (chromia) and aluminum oxides (alumina), and an interior aluminum nitride-rich region comprising aluminum nitride precipitates dispersed in a CrMoAl alloy matrix. The interior aluminum nitride precipitates act as oxygen sinks to sequester oxygen diffusing inward into the CrMoAl structure to prevent further oxidation of the underlying bulk alloy. Thus, the thermal pre-treatment protects the alloys from further oxidation upon subsequent exposure to higher temperature oxidizing environments.

Figure 1A:
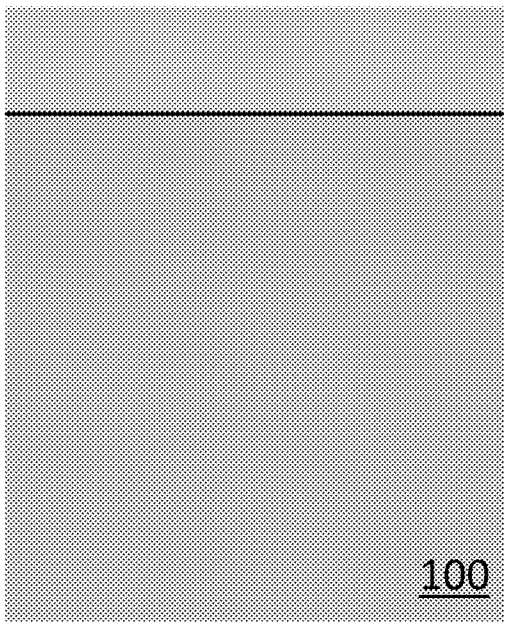
FIG. 1A-1E is a schematic diagram of a mechanism for the formation of an oxidation resistant film on the surface of a CrMoAl alloy.

A proposed mechanism for the formation of the oxidation-resistant films from single-phase CrMoAl alloys using a thermal pre-treatment is shown schematically in FIGS. 1A-1D. Prior to oxidation, the process begins with a single-phase ternary CrMoAl alloy 100 (FIG. 1A). Single-phase ternary CrMoAl alloy 100 may be in the form of a bulk material or object, such as a nose cone, or a coating on the surface of an underlying substrate or object. The single-phase ternary CrMoAl alloys can be formed using known methods for metal alloy fabrication. Such methods include forming a melt composed of stoichiometric quantities of Cr, Mo, and Al and casting and cooling the melt to form an object of the solid alloy. The solid alloy may optionally undergo an additional homogenization heat treatment in an oxygen-free environment to break up any as-cast inhomogeneities and achieve a uniform distribution of the elements in the alloy. The melt should be formed from very high purity stock—desirably having a purity of 2N or better. The single-phase CrMoAl alloys can be formed into more complex bulk objects using additive manufacturing processes, including directed energy deposition (DED) and laser powder bed fusion (LPBF).

Figure 1B:
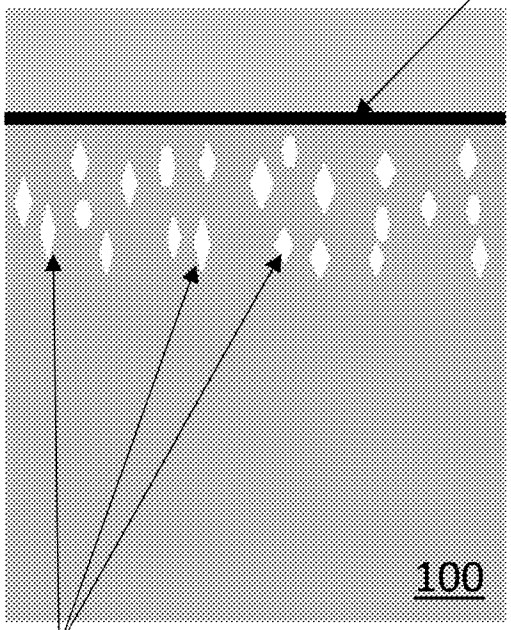
Figure 1C:
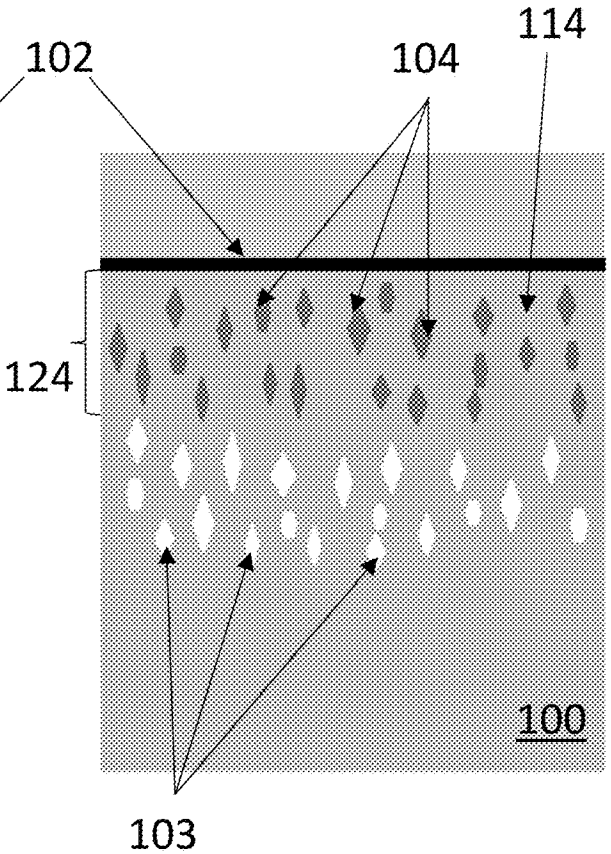

Once formed, CrMoAl alloy 100 is exposed to a heated, $N_{2(g)}$- and $O_{2(g)}$-containing atmosphere, whereby $N_{2(g)}$ diffuses into alloy 100 and a chromia-rich surface oxide layer 102 forms on the exterior surface of CrMoAl alloy 100 (FIG. 1B). Because nitrogen is a strong face centered cubic (FCC) phase stabilizer, aluminum precipitates 103 precipitate out of the CrMoAl alloy as the nitrogen diffuses inward (FIG. 1B). As $N_{2(g)}$ continues to diffuse into the alloy, it reacts with aluminum precipitates 103 forming aluminum nitride precipitates 104 within the body centered cubic (BCC) CrMoAl alloy matrix 114 (FIG. 1C). The portion of the stratified structure comprising the aluminum nitride precipitates dispersed in a CrMoAl alloy matrix is referred to herein as an aluminum nitride-rich layer 124.

As the process continues, $O_{2(g)}$ diffuses into CrMoAl alloy 100 behind the $N_{2(g)}$ front. Because the CrMoAl alloy matrix has an inherently low solubility for gaseous impurities, aluminum nitride precipitates 104 provide the primary diffusion path for the $O_2$, which reacts with the aluminum nitride precipitates to form more thermodynamically stable aluminum oxide (alumina) precipitates 105 dispersed in a CrMoAl alloy matrix 115. At temperatures above about 1354° C. the conversion from aluminum nitride to aluminum oxide may go through an aluminum oxy-nitride intermediary phase. In this way, the aluminum nitride precipitates act as an oxygen sink via their conversion into alumina precipitates that bind oxygen and prevent further oxidation of the CrMoAl alloy. The portion of the stratified structure comprising the alumina precipitates dispersed in a CrMoAl alloy matrix is referred to herein as an alumina-rich layer 125. The conversion of the aluminum nitride precipitates into alumina precipitates frees nitrogen to diffuse further into CrMoAl alloy 100 to continue the formation of aluminum precipitates 103 and aluminum nitride precipitates 104 deeper within CrMoAl alloy 100 (FIG. 1D). This process continues until eventually a stable stratified structure that is resistant to further oxygen ingress is formed in the surface of the alloy.

The optimal temperature of the heated atmosphere and the duration of the exposure of the CrMoAl alloy to the heated atmosphere used in the thermal pre-treatment may vary depending upon the exact composition of the starting alloy. Generally, however, temperatures, T, in the range of 1100° C.<T<1500° C. and times of 6 hours or more are suitable. This includes temperatures in the range of 1150° C.≤T≤1450° C., temperatures in the range from 1200° C.≤T≤1400° C., and temperatures in the range from 1300° C.≤T≤1400° C., and further includes times in the range from 12 hours to 36 hours, including times in the range from 12 hours to 24 hours.

In some embodiments of the methods, the atmosphere in which the starting CrMoAl alloy is treated may include a mixture of $N_{2(g)}$ and $O_{2(g)}$. Thus, the thermal treatment can be carried out in ambient air. In these embodiments, the $N_{2(g)}$ diffusion front precedes the $O_{2(g)}$ because $N_{2(g)}$ molecules diffuse more rapidly in the CrMoAl alloy than do larger $O_{2(g)}$ molecules. Alternatively, the thermal treatment can be carried out in stages, whereby the CrMoAl alloy is first exposed to a heated $N_{2(g)}$-containing atmosphere that is free of oxygen. This exposure is conducted in order to form aluminum precipitates 103 and aluminum nitride precipitates 104 in FIGS. 1B and 1C. The $N_{2(g)}$-containing atmosphere may consist only of $N_{2(g)}$ or may consist essentially of $N_{2(g)}$. In a subsequent stage, the CrMoAl alloy is first exposed to a heated $O_{2(g)}$-containing atmosphere that is free of nitrogen. This exposure is conducted in order to form the surface oxide layer and the aluminum oxide precipitates in FIG. 1D. The $O_{2(g)}$-containing atmosphere may consist only of $O_{2(g)}$ or may consist essentially of $O_{2(g)}$.

Since it may not be possible to achieve a completely oxygen- or nitrogen-free atmosphere, the terms "free of oxygen" and "free of nitrogen" include atmospheres in which the upper limit of the oxygen concentration or nitrogen concentration is determined only by the limitations on the ability of the equipment used to remove oxygen or nitrogen from the atmosphere. Similarly, since it may not be possible to achieve a nitrogen-pure or oxygen-pure atmosphere, the terms "consists only of $N_{2(g)}$" and "consists only of $O_{2(g)}$" include atmospheres in which the lower limit of the nitrogen concentration or oxygen concentration is determined only by limitations on the ability of the equipment used to remove other elements and molecules from the atmosphere. In embodiments of the methods that are carried out in stages, the thermal treatment times recited above are still applicable but refer to the total time for carrying out both stages.

Figure 1E:
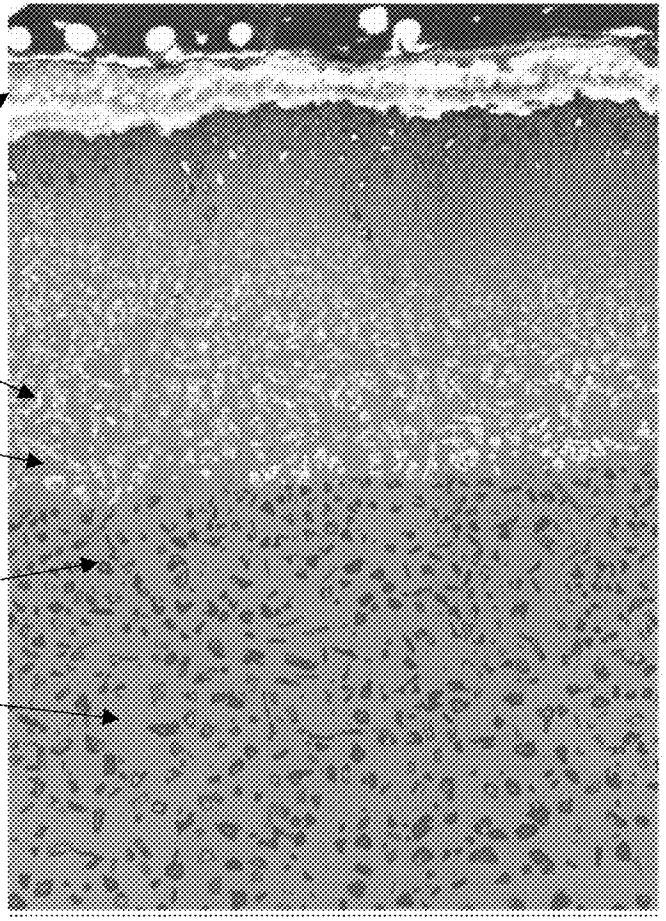
Figure 1D:
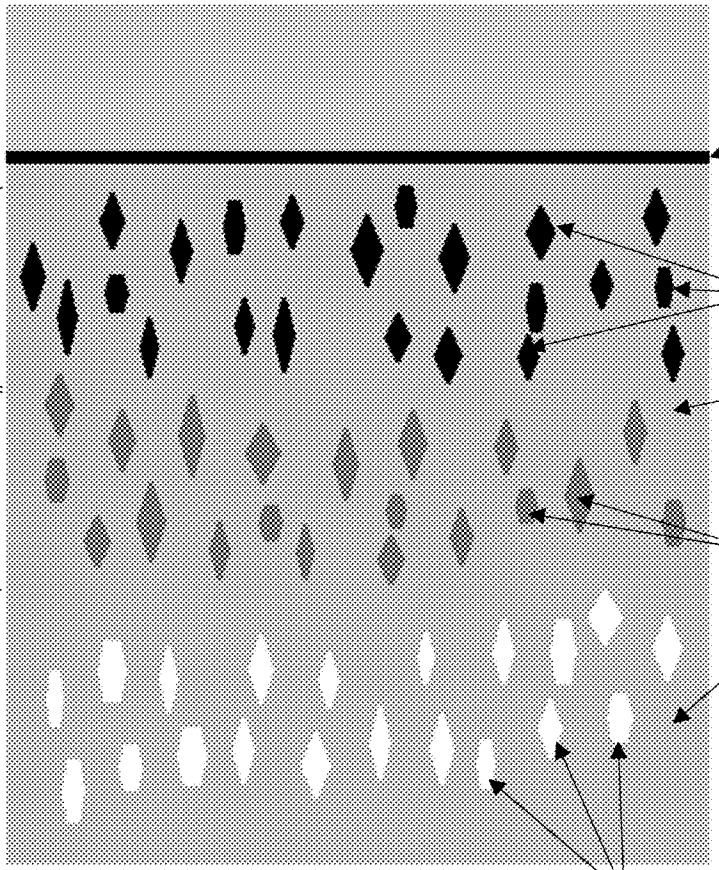

FIG. 1D is a diagram of the final stratified oxidation-resistant structure, and FIG. 1E is a scanning electron microscope (SEM) image showing the microstructure of a corresponding structure formed from a single-phase ternary CrMoAl alloy. More details regarding the process for forming and characterizing the structure of FIG. 1E are provided in the Example. In the final stratified structure, the exterior surface oxide layer comprises a mixture of chromium oxides and aluminum oxides. The surface oxide layer is desirably a continuous (i.e., unbroken) layer and is referred to as "chromia-rich" to indicate that chromium oxides make up most of the layer on a mole percent (mol. %) basis. Typically, chromium oxides make up at least 60 mol. % of surface oxide layer 102, with the balance of the layer being primarily aluminum oxides. The atomic ratio of chromium to aluminum in the surface layer is generally in the range from about 3:1 to about 6:1.

The alumina-rich layer comprising the dispersed alumina precipitates (white spots in FIG. 1B, black shapes in FIG. 1D) is adhered to the surface oxide layer. The alumina-rich layer is so called because the presence of the alumina precipitates provide the layer with a higher alumina concentration than the other layers in the stratified structure. The alumina precipitates, which sequester oxygen diffusing into the CrMoAl alloy, make up a substantial fraction of the alumina-rich layer. By way of illustration, alumina precipitates may make up at least 20 vol. % of the alumina-rich layer. For simplicity, the interface between surface oxide layer 102 and alumina rich layer 125 is depicted as a smooth and contiguous interface in FIG. 1D. However, as illustrated in FIG. 1B, the as-formed interface will generally be rough and may include a discontinuous transition region having a lower chromia to alumina molar ration at the interface.

The aluminum-nitride layer comprising the aluminum nitride precipitates (dark spots in FIG. 1B, gray shapes in FIGS. 1C and 1D) dispersed in a CrMoAl alloy matrix (gray area in FIG. 1B) is integrated with the overlying alumina-rich layer. The aluminum nitride-rich layer is so called because the presence of the aluminum nitride precipitates provide the layer with a higher aluminum nitride concentration than the other layers in the stratified structure. Aluminum nitride precipitates make up a substantial fraction of the aluminum nitride-rich layer. By way of illustration, aluminum nitride precipitates may make up at least 20 vol. % of the nitride-rich layer. In the as-formed stratified structure, aluminum oxide precipitates and aluminum nitride precipitates may coexist in an interfacial region between the alumina-rich layer and the aluminum nitride-rich layer.

Because the aluminum in the alumina-rich layer and the aluminum nitride-rich layer is primarily segregated into the precipitates, the CrMoAl alloy matrices in these layers will generally have a lower aluminum content and higher chromium and molybdenum contents than the single-phase ternary CrMoAl alloys from which the stratified structures are formed.

The thicknesses of the layers in the stratified structure will depend on the temperature and duration of the thermal treatment. Typically, the surface oxide layer will have a thickness of 100 μm or lower and more typically a thickness of 60 μm or lower. By way of illustration, the thickness of the surface oxide layer may be in the range from about 40 μm to about 60 μm. Because the thickness of the surface oxide layer is not uniform on a microscopic scale, for the purposes of this disclosure, the thickness of the oxide layer refers to the maximum thickness of the surface oxide layer. The oxygen penetration depth into the CrMoAl alloy can be determined by the distance from the exterior surface of the surface oxide layer to the depth of the deepest alumina precipitate. Typically, the oxygen penetration depth in the stratified structures is less than 500 μm and more typically less than 400 μm. By way of illustration, the oxygen penetration depth may be in the range from about 200 μm to about 300 μm.

The thermally treated CrMoAl alloys are characterized by excellent high-temperature and oxidation resistance (survivability), as measured by the ability of the stratified structure at the surface of the alloys to retain its structure without significant performance degradation of the CrMo matrix upon subsequent exposure to high temperatures for extended periods of time. One test for measuring the survivability of the thermally treated CrMoAl alloys is presented the Example below. Briefly, after exposure to multiple cycles of exposure to a continually refreshed ambient dry air atmosphere at a fixed temperature of 1600° C. and 1 atm pressure for a total exposure time of 120 hours no obvious structural degradation of the alloy is observed. The survivability of the thermally treated CrMoAl alloys is also reflected in their low gas pick-up, as measured by thermogravimetric analysis after 24 hours of exposure to high temperature (e.g., 1600° C.). Survivability under these conditions is important for applications in extreme high-temperature oxidizing environments where many other alloys fail.

Example

This example illustrate methods for forming and characterizing oxidation-resistant coatings on single-phase ternary CrMoAl alloys.

With the goal of identifying alloys of chromium, molybdenum, and aluminum that form oxidation-resistant surface films for use in extreme thermal environments. Six alloys were from three different phase fields of the ternary phase diagram for Mo—Cr—Al to survey the ternary space for potentially useful oxidation behavior. The six samples, MoCrAl 1-MoCrAl 6, their atomic compositions, and their predicted phase compositions are shown in Table 1. (For consistency, Sample 1 is designated an "MoCrAl" sample, although Cr is the base element in that sample and, therefore, it can also be referred to as a "CrMoAl" sample)

TABLE 1

Sample Alloys for Testing.

| Sample | Target Composition (at %) | | | Predicted Phase Composition | | |
|---|---|---|---|---|---|---|
| ID | Mo % | Cr % | Al % | Phase 1 | Phase 2 | Phase 3 |
| MoCrAl 1 | 16.40 | 66.80 | 16.80 | Cr, Mo SS (100%) | N/A | N/A |
| MoCrAl 2 | 52.80 | 33.30 | 13.90 | Cr, Mo SS (52.6%) | Mo3Al (20.0%) | Mo, CrSS (27.4%) |
| MoCrAl 3 | 53.50 | 32.50 | 14.00 | Cr, Mo SS (53.7%) | Mo3Al (21.1%) | Mo, Cr SS (25.2%) |
| MoCrAl 4 | 67.00 | 28.00 | 5.00 | Cr, Mo SS (59.7%) | Mo3Al (33.9%) | Mo, Cr SS (6.4%) |
| MoCrAl 5 | 39.20 | 37.80 | 23.00 | Cr, Mo SS (45.3%) | Mo3Al (2.5%) | Mo, Cr SS (52.2%) |
| MoCrAl 6 | 23.60 | 33.60 | 42.80 | Cr, Mo SS (7.3%) | Mo3Al (54.1%) | Cr5Al8 (38.6%) |

SS = Solid Solution.

The alloy samples were prepared via arc melting of elemental stock of at least 2N purity. Samples were flipped and remelted five times during their preparation, producing hemispherical ingots. Ingots were homogenized at 1300° C. for 24 hours in ultra-high vacuum wrapped in tantalum foil in order to break up any as-cast inhomogeneities. The tantalum foil was still found to be ductile after the heat treatment, indicating an extremely low oxygen level. These ingots were then cut with a slow cut saw into wedges of approximately equal size which would be used for the oxidation experiments.

In a first experiment Samples 1-6 were oxidized at high temperature in a molybdenum disilicide box furnace capable of operating up to 1700° C. Samples were exposed to a fixed temperature for a 24-hour period in a continually refreshed atmosphere of dry environmental air defined as atmospheric chemistry at 1 atm pressure. Samples were present in the furnace for the ramp up and cool down cycles. The evaluation began at 1000° C. with six total samples. A sample was eliminated from further testing when 24 hours of continuous exposure rendered the sample oxidized through. The choice to include thermal ramp and require performance across a broad temperature range was chosen to more accurately screen compositions that would be useful in real world applications, which may require resistance to thermal gradients and stability over a wide temperature range. These evaluations were repeated up to 1600° C.

As shown by the results reported in Table 2, where "X" indicates sample failure and "O" indicates sample survival, the only sample that survived the testing was Sample 1 ($Cr_{0.668}Mo_{0.164}Al_{0.168}$).

TABLE 2

Results of High-Temperature Oxidation Testing.

| Sample # | 700° C. | 1000° C. | 1300° C. | 1500° C. |
|---|---|---|---|---|
| 1 | O | O | O | O |
| 2 | O | X | n/a | n/a |
| 3 | X | X | n/a | n/a |
| 4 | X | X | n/a | n/a |
| 5 | O | X | n/a | n/a |
| 6 | O | X | n/a | n/a |

In a second experiment, Sample 1 the microstructural evolution of Sample 1 was examined a different thermal pre-treatment temperatures to gain a better understanding of superior oxidative performance. Two ingots of a master alloy of Sample 1 were prepared via arc melting from elemental stock of 2N purity. Two ingots were made to ensure there was enough material for all testing. These ingots were melted a total of five times and flipped in between melts. Ingots were visually confirmed to be fully liquified and were stirred magnetically. Time under the arc was kept to a minimum in order to minimize the volatilization of chromium and aluminum. Both ingots were heat treated at 1300° C. for 24 hours in ultra-high vacuum wrapped in tantalum foil to remove any as-cast inhomogeneities. The tantalum foil was still found to be ductile after heat treatment. Scanning electron microscopy of a control sample showed a continuous solid solution of the expected composition, indicating successful heat treatment. Master alloy ingots were again cut into wedges and chosen at random from ingot 1 or ingot 2. Samples of Sample 1 were again exposed for 24 hours in dry atmospheric air at 1 atm from temperatures ranging from 1000° C. to 1600° C., with a freshly prepared ingot wedge used at each temperature. Additionally, one wedge was present in the furnace for all high temperature runs, accumulating a total 120 hours of high temperature exposure from 1000° C. to 1600° C. and showing excellent survivability.

Figure 2A:
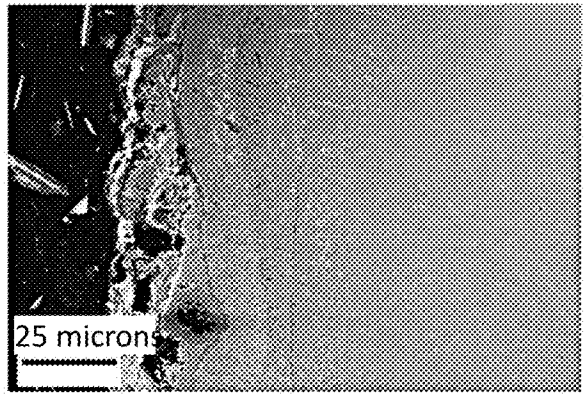
FIGS. 2A-2F show images showing the microstructural evolution of the MoCrAl-1 alloy of the Example at different temperature exposures: 1000° C.
Figure 2B:
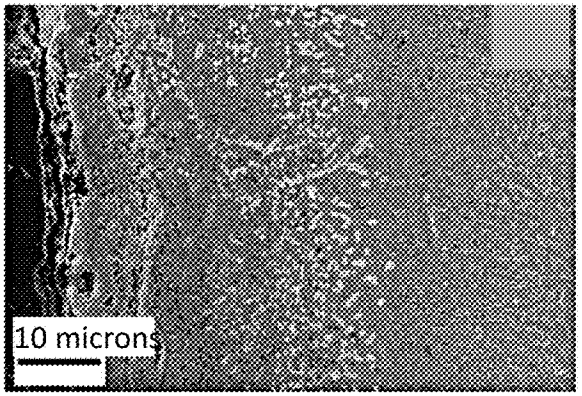
Figure 2C:
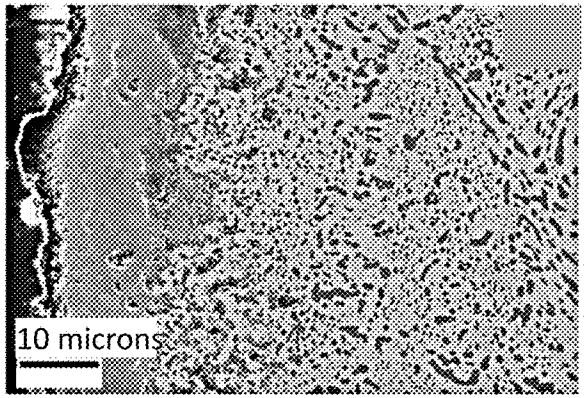
Figure 2D:
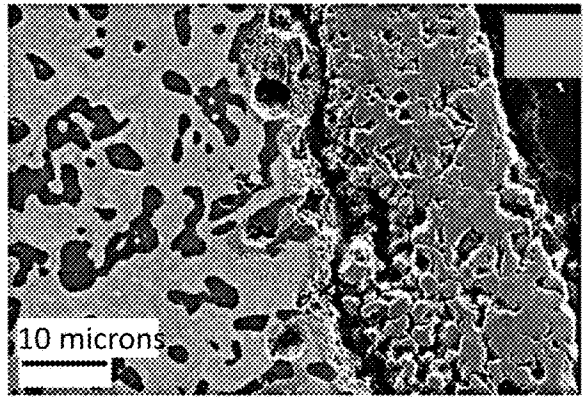
Figure 2E:
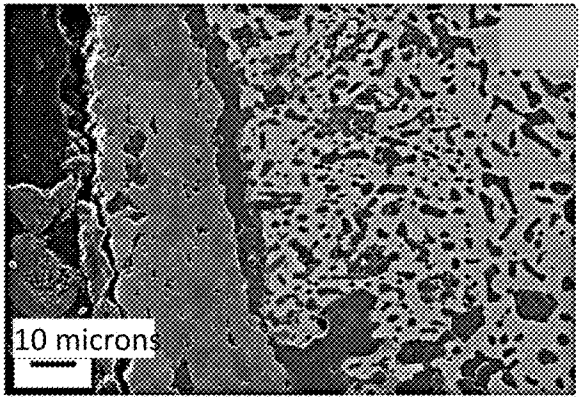
Figure 2F:
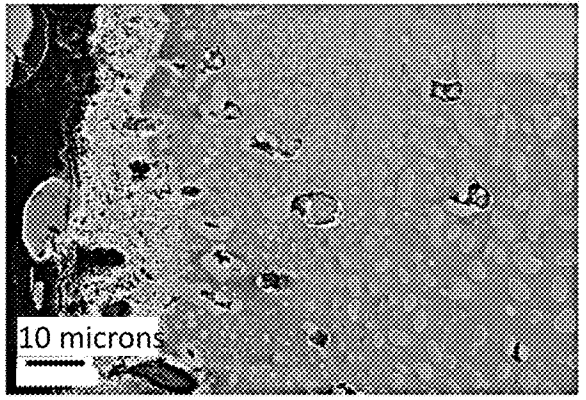
Figure 3:
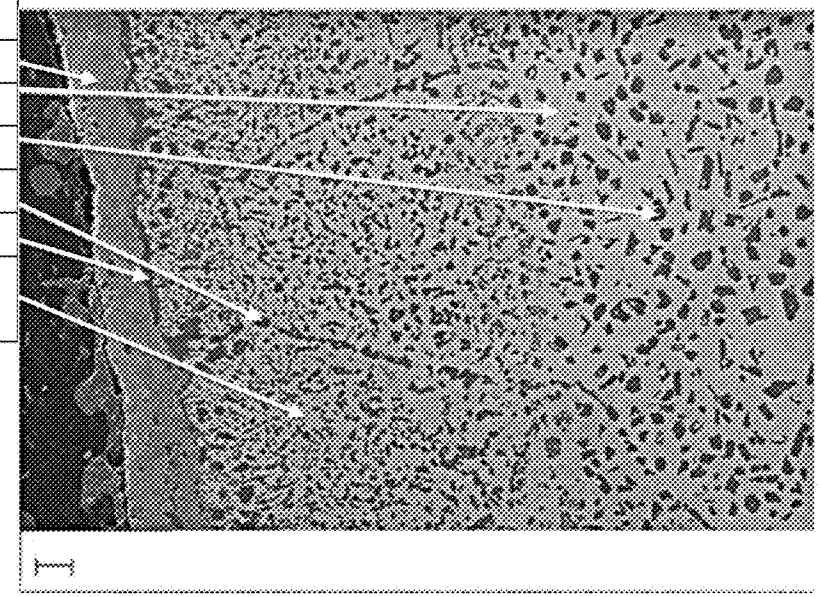
FIG. 3 shows the atomic composition (Table left) of the stratified structure formed in the surface of MoCrAl-1 alloy (EDS image, right) of the Example.

The microstructural evolution of the Sample 1 alloy for thermal pre-treatment temperatures from 1000° C. to 1500° C. is shown in the images of FIGS. 2A-2F, where FIG. 2E is an enlarged view of a portion of the CrMoAl alloy shown in FIG. 1E and the oxidation-resistant layered structure that forms upon thermal treatment is described in detail in the description of FIG. 1E, above. The composition of the surface oxide layer, the precipitates, and the matrices of the stratified structure of FIGS. 1E and 2E is provided in the table of FIG. 3. In FIG. 3, the Oxide is the surface oxide layer, the Dark Phase Behind Oxide is a transition region at the interface of the surface oxide layer and the underlying alumina-rich layer. The Light Precip are the alumina precipitates, the Matrix Behind Oxide Front is the CrMoAl matrix in which the alumina precipitates are dispersed, the Dark Precip are the aluminum nitride precipitates, and the Bulk forward of Oxygen is the CrMoAl matrix in which the aluminum nitride precipitates are dispersed. Images were taken in a scanning electron microscope using secondary electron imaging at 5 kEv. Composition data was gathered with energy dispersive spectroscopy (EDS).

A third experiment was conducted to gain a better understanding of the mechanism of protection present in Sample 1 and the failure modes of Samples 2-6 from the first experiment. The third experiment tested Samples 1 and 6 from the first experiment, as well as a new alloy, Sample 7, which represents a region of the Mo—Cr—Al ternary phase diagram from which Samples 2, 3, 4, and 5 were located. Sample 7 was chosen to be in the middle of the ternary space under the assumption that its oxidation performance and failure mechanism would be similar to that of Samples 2-5, which was later confirmed by the experiment.

Figure 4:
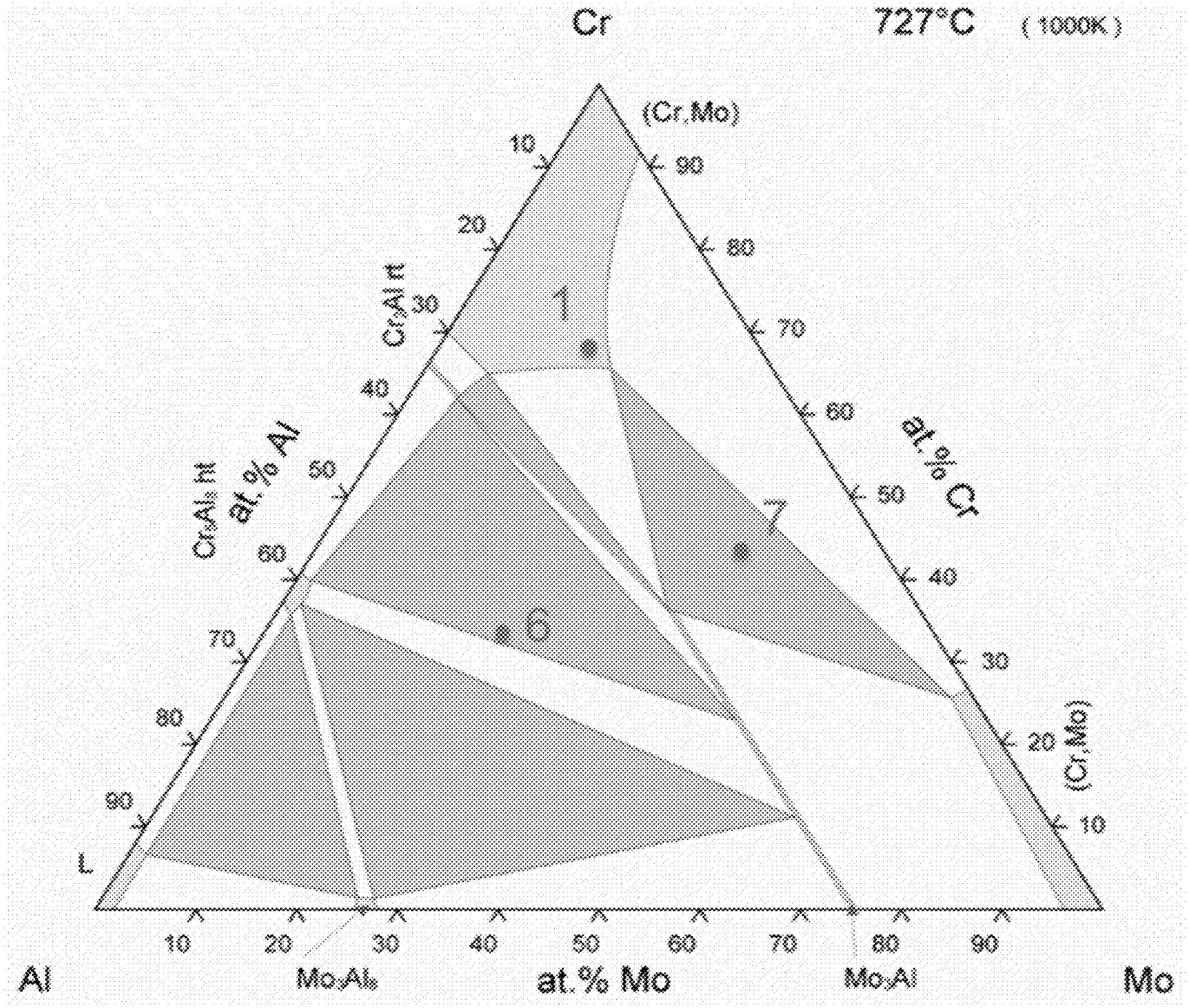
FIG. 4 is a ternary Cr—Mo—Al phase diagram at 727° C.

For these experiments, master ingots of the Sample 1, 6, and 7 alloys were prepared. The ingots of Samples 1, 6, and 7 were tantalum wrapped and homogenized at 1300° C. for 24 hours in ultra-high vacuum. Control samples were examined after heat treatment to confirm successful heat treatment. All three alloy samples were exposed at two different isotherms (727° C. and 1227° C.) on a parabolic time scale such that the evolution of their microstructures could be compared and the failure mechanisms of the other alloys identified. A low temperature (727° C.) Mo—Cr—Al ternary phase diagrams with the Sample alloys labeled is shown in FIG. 4.

Figure 5A:
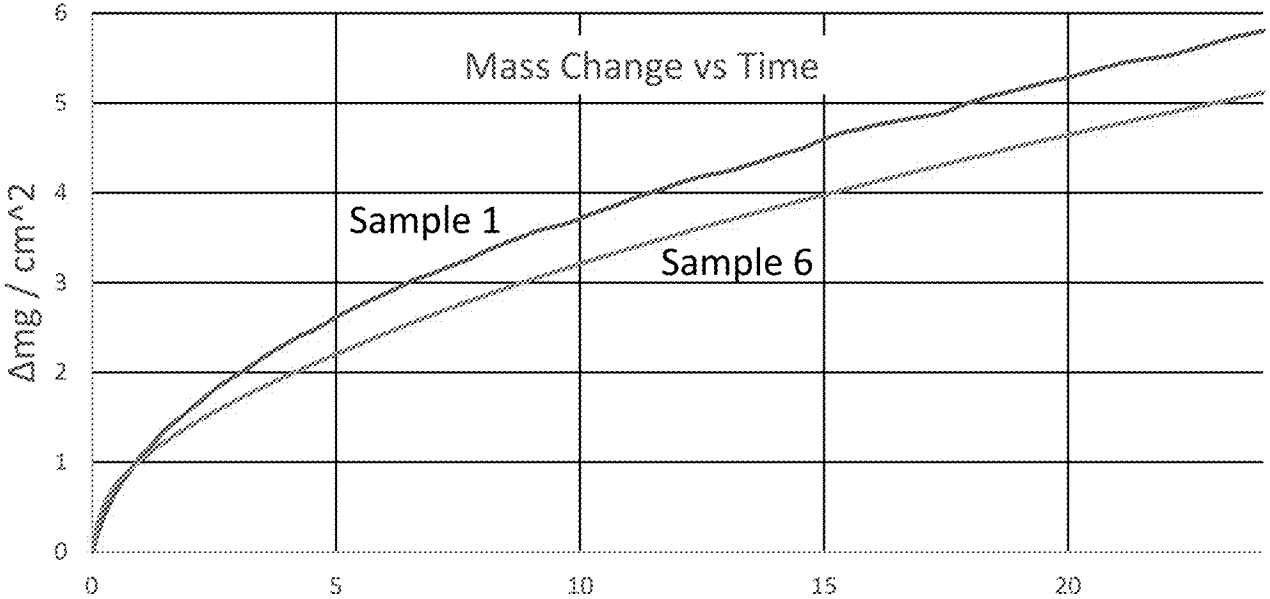
FIGS. 5A-5B show thermogravimetric analysis curves for Samples 1, 6, and 7 of the Example at 1100° C.
Figure 5B:
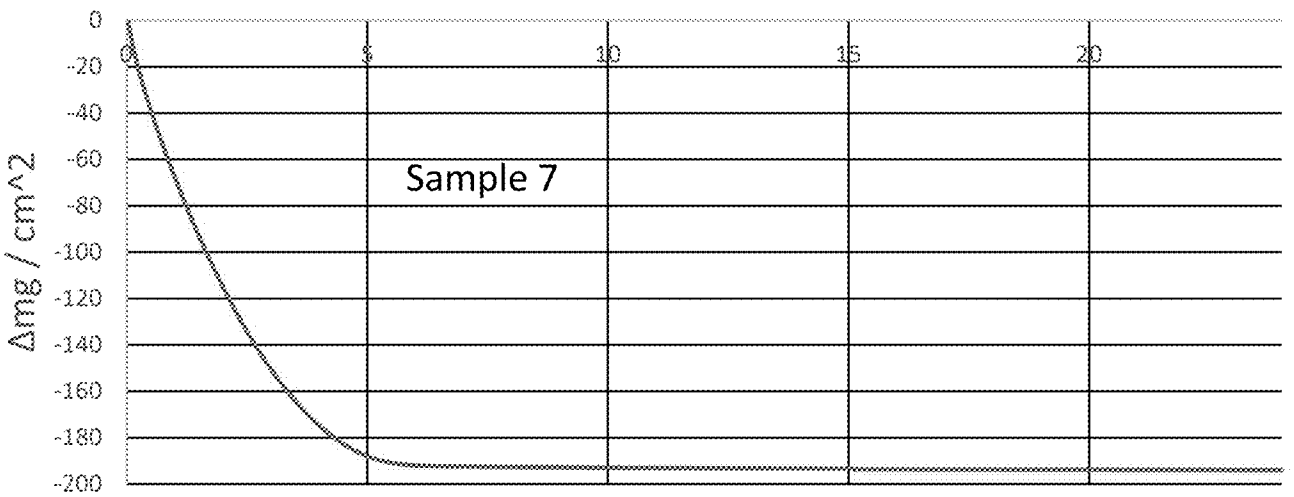
Figure 6A:
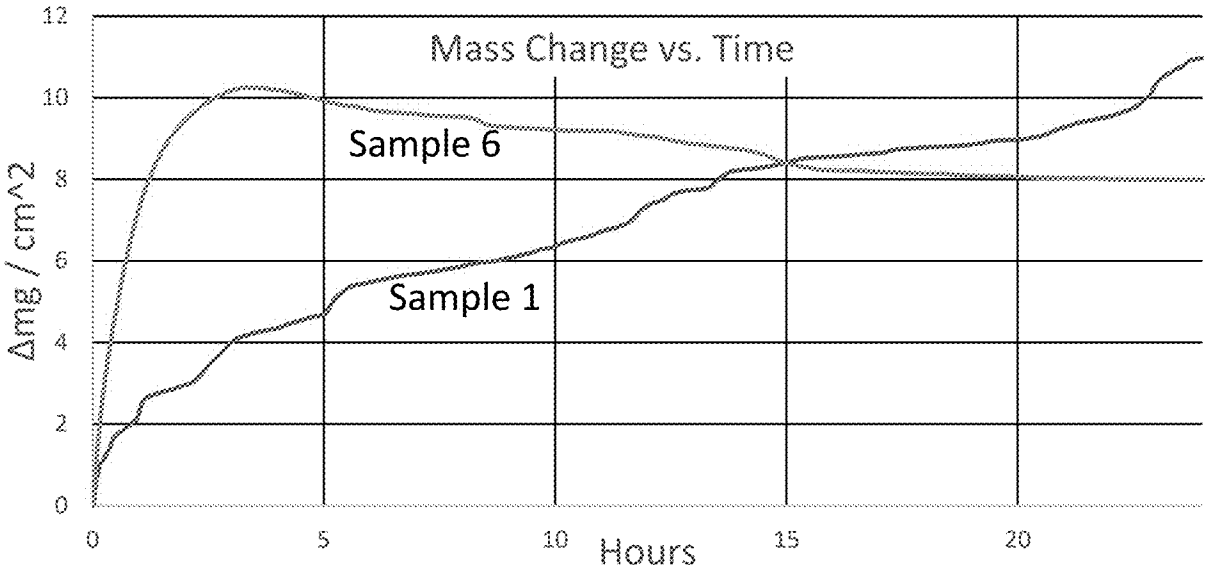
FIGS. 6A-6B show thermogravimetric analysis curves for Samples 1, 6, and 7 of the Example at 1300° C.
Figure 6B:
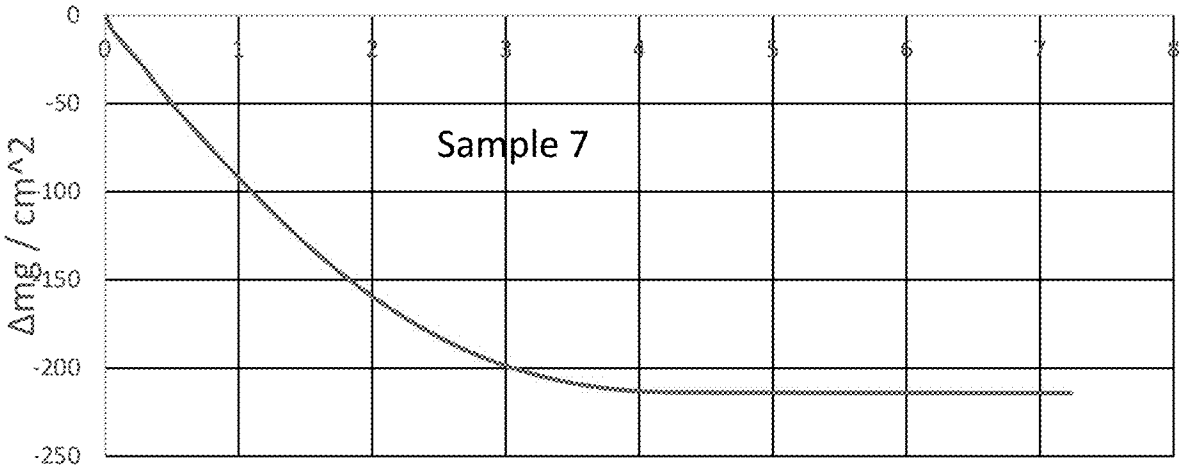

Thermogravimetric analysis (TGA) curves were generated for Samples 1, 6, and 7 to identify the mass loss over time and calculate an activation energy. The TGA curves for the three samples at 1100° C. are shown in FIGS. 5A-5B and the TGA curves for the three samples at 1300° C. are shown in FIGS. 6A-6B. The lower temperature TGA curves for Samples 1 and 6 in FIG. 5A show only a minimal mass gain—likely due to the uptake of atmospheric gas. At this temperature, little if any aluminum nitride has formed, but aluminum precipitation is observed and chromia is the predominant oxide species formed. In contrast, as shown in FIG. 5B, Sample 7 rapidly lost mass from onset of heating and was oxidized through in 7 hours. The higher temperature TGA curves for Samples 1 and 6 in FIG. 6A show that Sample 1 undergoes an increased mass gain over sample 6 at an inconsistent rate, which is consistent with the formation of an aluminum nitride precipitate phase in Sample 1. Sample 7 again rapidly lost mass from onset of heating and was oxidized through in 4 hours.

The foregoing description of illustrative embodiments of the invention has been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An article of manufacture comprising a single-phase ternary chromium-molybdenum-aluminum alloy having the composition $Cr_{(1-x-y)}Mo_xAl_y$, where $0.10 \leq x \leq 0.20$ and $0.10 \leq y \leq 0.20$.

2. The article of manufacture of claim 1, where $0.14 \leq x \leq 0.18$ and $0.14 \leq y \leq 0.18$.

3. The article of manufacture of claim 1, wherein the article of manufacture is an ingot.

4. The article of manufacture of claim 1, wherein the article of manufacture is a coating on a substrate.

5. The article of manufacture of claim 1, wherein the article of manufacture is a component of an aircraft, a missile, a rocket, or a space vehicle.

6. The article of manufacture of claim 4, wherein the substrate is a component of an aircraft, a missile, a rocket, or a space vehicle.

7. A method of fabricating an article of manufacture comprising a single-phase ternary chromium-molybdenum-aluminum alloy having the composition $Cr_{(1-x-y)}Mo_xAl_y$, where $0.10 \leq x \leq 0.20$ and $0.10 \leq y \leq 0.20$, the method comprising forming a melt composed of stoichiometric quantities of Cr, Mo, and Al and cooling the melt to solidify the single-phase ternary chromium-molybdenum-aluminum alloy having the composition $Cr_{(1-x-y)}Mo_xAl_y$, where $0.10 \leq x \leq 0.20$ and $0.10 \leq y \leq 0.20$, wherein the solidified single-phase ternary chromium-molybdenum-aluminum alloy is formed into an article of manufacture by casting and cooling the melt, by forming a coating of the single-phase ternary chromium-molybdenum-aluminum alloy on a substrate, by laser powder bed fusion (LPBF), or by directed energy deposition (DED).

8. The method of claim 7, wherein the article of manufacture is formed by forming the coating of the single-phase ternary chromium-molybdenum-aluminum alloy on a substrate and the substrate is a component of an aircraft, a missile, a rocket, or a space vehicle.

9. The method of claim 7, wherein the article of manufacture is formed by the laser powder bed fusion (LPBF) or by the directed energy deposition (DED).

10. A method of forming an oxidation-resistant chromium-molybdenum-aluminum alloy, the method comprising:

forming a single-phase ternary chromium-molybdenum-aluminum alloy having the composition $Cr_{(1-x-y)}Mo_xAl_y$, where $0.10 \leq x \leq 0.20$ and $0.10 \leq y \leq 0.20$; and exposing the single-phase ternary chromium-molybdenum-aluminum alloy to a heated atmosphere comprising nitrogen gas and oxygen gas at a temperature, T, and for a time sufficient to form a stratified structure comprising:

a base layer of a ternary chromium-molybdenum-aluminum alloy;

a nitride-rich layer over the base layer, the nitride-rich layer comprising aluminum nitride precipitates dispersed in a chromium-molybdenum-aluminum alloy matrix;

an oxide-rich layer over the nitride-rich layer, the oxide-rich layer comprising aluminum oxide precipitates dispersed in a chromium-molybdenum-aluminum alloy matrix; and a chromia-rich surface oxide layer over the oxide-rich layer, the chromia-rich surface oxide layer comprising chromium oxides and aluminum oxides.

11. The method of claim 10, where $0.14 \leq x \leq 0.18$ and $0.14 \leq y \leq 0.18$.

12. The method of claim 10, wherein 1100° C.<T<1500° C.

13. The method of claim 10, wherein 1200° C.<T<1400° C.

14. The method of claim 10, wherein the time is in the range from 6 hours to 36 hours.

15. The method of claim 10, wherein exposing the single-phase ternary chromium-molybdenum-aluminum alloy to the heated atmosphere comprising nitrogen gas and oxygen gas comprises exposing the single-phase ternary chromium-molybdenum-aluminum alloy to a heated ambient air.

16. The method of claim 10, wherein exposing the single-phase ternary chromium-molybdenum-aluminum alloy to the heated atmosphere comprising nitrogen gas and oxygen gas comprises exposing the single-phase ternary chromium-molybdenum-aluminum alloy to a heated oxygen-free atmosphere comprising the nitrogen gas and subsequently exposing the ternary chromium-molybdenum-aluminum alloy to a heated nitrogen-free atmosphere comprising the oxygen gas.

17. The method of claim 10, wherein the atomic ratio of chromium to aluminum in the chromia-rich surface oxide layer is in the range from 3:1 to 6:1.

18. The method of claim 17, wherein the volume fraction of aluminum oxide precipitates in the oxide-rich layer is at least 0.2 and the volume fraction of aluminum nitride precipitates in the nitride-rich layer is at least 0.2.

19. The method of claim 10, further comprising applying the single-phase ternary chromium-molybdenum-aluminum alloy as a coating on a substrate.

20. The method of claim 19, wherein the substrate is a component of an aircraft, a missile, a rocket, or a space vehicle.

* * * * *